US010181329B2

(12) United States Patent
Lepauloux et al.

(10) Patent No.: US 10,181,329 B2
(45) Date of Patent: Jan. 15, 2019

(54) AUDIO PROCESSING CIRCUIT AND METHOD FOR REDUCING NOISE IN AN AUDIO SIGNAL

(71) Applicant: Intel IP Corporation, Santa Clara, CA (US)

(72) Inventors: Ludovick Lepauloux, Cannes (FR); Fabrice Plante, Rockville, MD (US); Christophe Beaugeant, Mouans Sartoux (FR)

(73) Assignee: Intel IP Corporation, Santa Clara, CA (US)

( * ) Notice: Subject to any disclaimer, the term of this patent is extended or adjusted under 35 U.S.C. 154(b) by 0 days.

(21) Appl. No.: 15/501,192

(22) PCT Filed: Sep. 5, 2014

(86) PCT No.: PCT/IB2014/002559
§ 371 (c)(1),
(2) Date: Feb. 2, 2017

(87) PCT Pub. No.: WO2016/034915
PCT Pub. Date: Mar. 10, 2016

(65) Prior Publication Data
US 2017/0236528 A1 Aug. 17, 2017

(51) Int. Cl.
*G10L 21/0232* (2013.01)
*G10L 21/0264* (2013.01)
(Continued)

(52) U.S. Cl.
CPC ..... *G10L 21/0232* (2013.01); *G10L 21/0264* (2013.01); *G10L 25/84* (2013.01); *G10L 25/78* (2013.01)

(58) Field of Classification Search
CPC .. G10L 21/0232; G10L 21/0264; G10L 25/84
(Continued)

(56) References Cited

U.S. PATENT DOCUMENTS 9,020,144 B1 * 4/2015 Yang ..... H04M 9/082 379/406.05
9,721,584 B2 * 8/2017 Chatlani ..... G10L 21/0232
(Continued)

OTHER PUBLICATIONS

Nelke Christoph Matthias et al.: "Dual microphone noise PSD estimation for mobile phones in hands-free position exploiting the coherence and speech presence probability", IEEE International Conference on Acoustics, Speech and Signal Processing (ICASSP), May 2013, Vancouver, Canada.

(Continued)

*Primary Examiner* — Edwin S Leland, III
(74) *Attorney, Agent, or Firm* — Viering, Jentschura & Partner MBB

(57) ABSTRACT

An audio processing device includes a first microphone configured to receive a first signal a second microphone configured to receive a second signal, a noise reduction gain determination circuit configured to determine a noise reduction gain based on the first signal and the second signal, a noise reduction circuit configured to attenuate the first signal based on the determined noise reduction gain, and an output circuit configured to output the attenuated signal.

23 Claims, 7 Drawing Sheets

(51) Int. Cl.
*G10L 25/84* (2013.01)
*G10L 25/78* (2013.01)

(58) Field of Classification Search
USPC ..... 704/233
See application file for complete search history.

(56) References Cited

U.S. PATENT DOCUMENTS

2002/0193130 A1* 12/2002 Yang ..... H04R 3/005 455/501
2003/0040908 A1* 2/2003 Yang ..... H04R 3/005 704/233
2005/0278172 A1* 12/2005 Koishida ..... G10L 21/0208 704/227
2009/0299742 A1* 12/2009 Toman ..... G10L 21/0208 704/233
2011/0231187 A1* 9/2011 Sekiya ..... G10L 21/0208 704/233
2011/0305345 A1* 12/2011 Bouchard ..... G10L 21/0208 381/23.1
2013/0054231 A1 2/2013 Jeub et al.
2013/0191118 A1* 7/2013 Makino ..... G10L 21/0216 704/226
2014/0140555 A1* 5/2014 Pilgrim ..... H04R 25/407 381/317
2014/0177868 A1* 6/2014 Jensen ..... H04R 3/002 381/94.7
2014/0200881 A1* 7/2014 Chatlani ..... G10L 21/0264 704/205
2014/0226827 A1* 8/2014 Abdollahzadeh Milani ..... G10L 21/0224 381/56
2016/0012828 A1* 1/2016 Chatlani ..... G10L 21/0232 704/205
2016/0055863 A1* 2/2016 Kato ..... G10L 21/0232 704/203
2016/0078856 A1* 3/2016 Lee ..... G10L 21/0232 381/94.2
2016/0225388 A1* 8/2016 Nelke ..... H04R 3/00
2016/0372131 A1* 12/2016 Niwa ..... G10L 21/0264
2017/0125033 A1* 5/2017 Kjems ..... G10L 21/0232
2017/0236528 A1* 8/2017 Lepauloux ..... G10L 21/0264 704/233

OTHER PUBLICATIONS

International Search Report based on Application No. PCT/IB2014/002559 (4 Pages) dated Jun. 18, 2015 (Reference Purpose Only).

* cited by examiner

AUDIO PROCESSING CIRCUIT AND METHOD FOR REDUCING NOISE IN AN AUDIO SIGNAL

RELATED APPLICATIONS

The present application is a national stage entry according to 35 U.S.C. § 371 of PCT application No. PCT/IB2014/002559 filed on Sep. 5, 2014, and is incorporated herein by reference in its entirety.

TECHNICAL FIELD

The present disclosure relates to audio processing circuits and methods for reducing noise in an audio signal.

BACKGROUND

In a voice call with a communication device (for example a mobile device, for example a mobile radio communication device), there is typically a high level of background noise, e.g. traffic noise or other people talking. Because such background noise decreases the quality of the call experienced by the participants of the call, background noise should typically be reduced. In particular, noise reduction in presence of echo signal is an important issue for communication devices. However, due to limited processing power and memory of mobile devices, noise reduction methods which are based on complex models such as source separation, acoustic scene analysis, may not be suitable for implementation in mobile devices. Accordingly, efficient approaches to reduce background noise that disturbs the call quality and the intelligibility of the voice signal transmitted during a voice call are desirable.

BRIEF DESCRIPTION OF THE DRAWINGS

In the drawings, like reference characters generally refer to the same parts throughout the different views. The drawings are not necessarily to scale, emphasis instead generally being placed upon illustrating the principles of various aspects of this disclosure. In the following description, various aspects are described with reference to the following drawings, in which.

DESCRIPTION

The following detailed description refers to the accompanying drawings that show, by way of illustration, specific details and aspects of this disclosure in which various aspects of this disclosure may be practiced. Other aspects may be utilized and structural, logical, and electrical changes may be made without departing from the scope of various aspects of this disclosure. The various aspects of this disclosure are not necessarily mutually exclusive, as some aspects of this disclosure can be combined with one or more other aspects of this disclosure to form new aspects. It will be understood that the terms "audio processing device" and "audio processing circuit" are used interchangeably herein.

Figure 1:
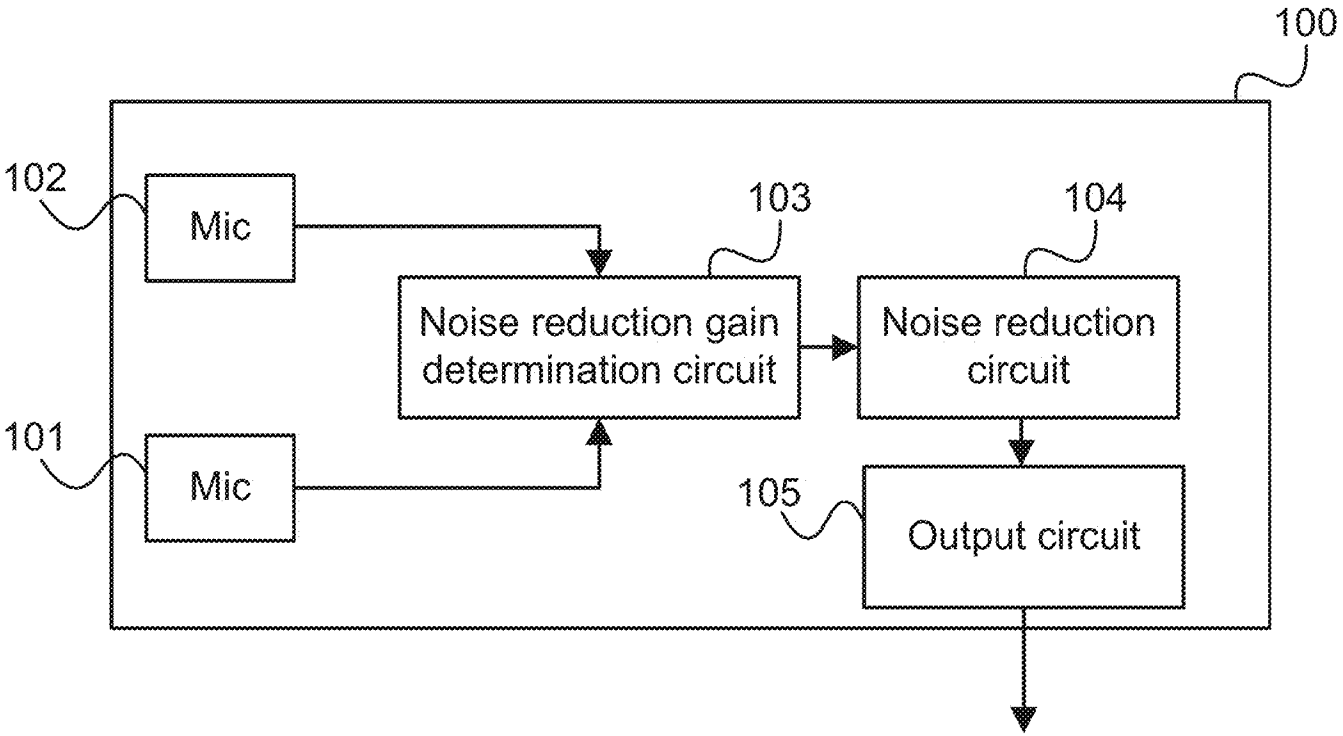
FIG. 1 shows an audio processing device.

FIG. 1 shows an audio processing device 100.

The audio processing device 100 includes a first microphone 101 configured to receive a first signal and a second microphone configured to receive a second signal 102.

The audio processing device 100 further includes a noise reduction gain determination circuit 103 configured to determine a noise reduction gain based on the first signal and the second signal and a noise reduction circuit 104 configured to attenuate the first signal based on the determined noise reduction gain.

Further, the audio processing device 100 includes an output circuit 105 configured to output the attenuated signal.

In other words, an audio processing device 100 is provided for a communication device, e.g. a mobile phone, with two microphones, which determines a noise reduction based on the input received from the two microphones.

The components of the audio processing device (e.g. the noise reduction gain determination circuit, the noise reduction circuit, the output circuit etc.) may for example be implemented by one or more circuits. A "circuit" may be understood as any kind of a logic implementing entity, which may be special purpose circuitry or a processor executing software stored in a memory, firmware, or any combination thereof. Thus a "circuit" may be a hard-wired logic circuit or a programmable logic circuit such as a programmable processor, e.g. a microprocessor. A "circuit" may also be a processor executing software, e.g. any kind of computer program. Any other kind of implementation of the respective functions which will be described in more detail below may also be understood as a "circuit".

Figure 2:
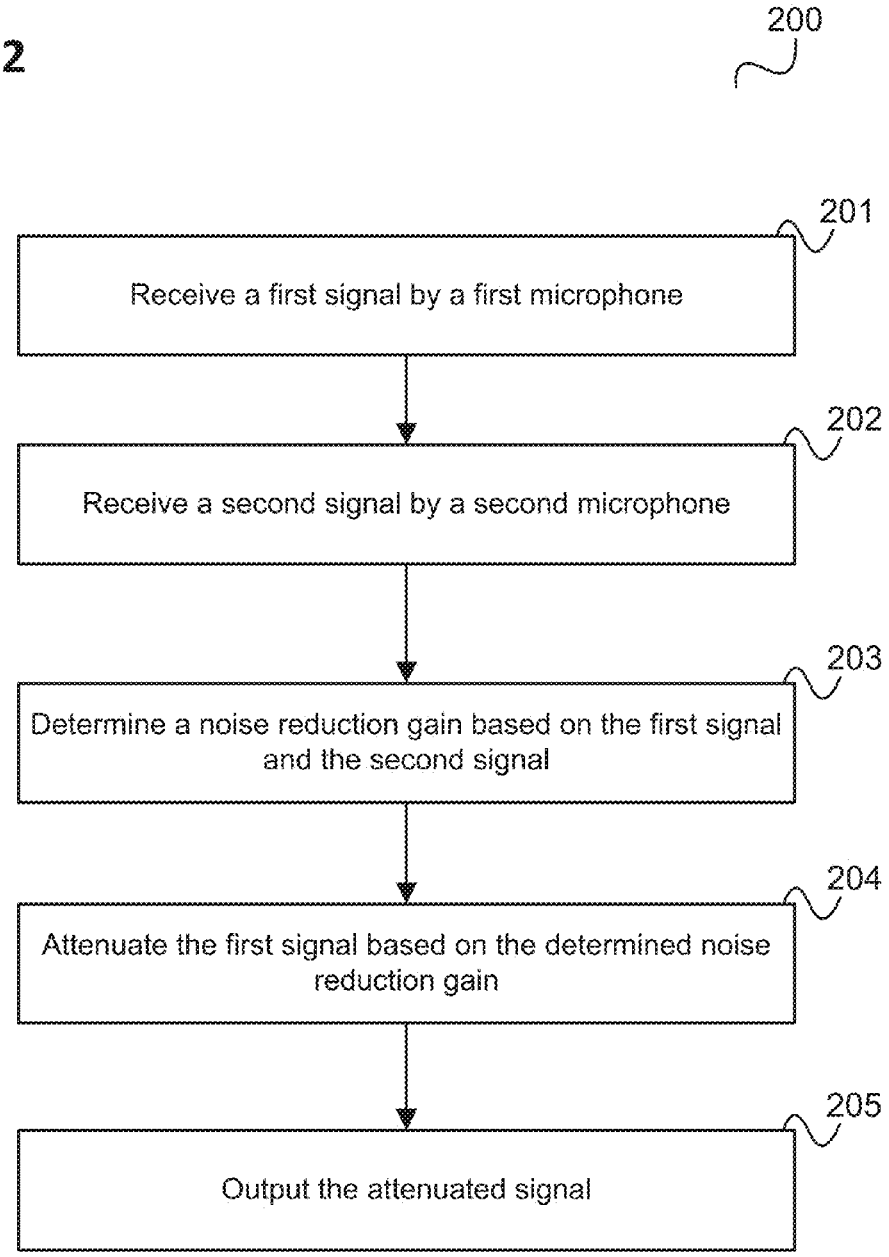
FIG. 2 shows a flow diagram illustrating a method for reducing noise in an audio signal, for example carried out by an audio processing circuit.

The audio processing device 100 for example carries out a method as illustrated in FIG. 2.

FIG. 2 shows a flow diagram 200 illustrating a method for reducing noise in an audio signal, for example carried out by an audio processing circuit.

In 201, the audio processing circuit receives a first signal by a first microphone.

In 202, the audio processing circuit receives a second signal by a second microphone.

In 203, the audio processing circuit determines a noise reduction gain based on the first signal and the second signal.

In 205, the audio processing circuit attenuates the first signal based on the determined noise reduction gain.

In 206, the audio processing circuit outputs the attenuated signal.

The following examples pertain to further embodiments.

Example 1, as described with reference to FIG. 1, is an audio processing device comprising: a first microphone configured to receive a first signal; a second microphone configured to receive a second signal; a noise reduction gain determination circuit configured to determine a noise reduction gain based on the first signal and the second signal; a noise reduction circuit configured to attenuate the first signal based on the determined noise reduction gain; and an output circuit configured to output the attenuated signal.

In Example 2, the subject matter of Example 1 can optionally include a voice activity detection circuit configured to assess whether a speech signal is present in the first signal.

In Example 3, the subject matter of any one of Examples 1-2 can optionally include that the voice activity detection circuit is configured to assess whether there is a speech signal corresponding to speech of a user of the audio processing device present in the first signal.

In Example 4, the subject matter of any one of Examples 2-3 can optionally include that the voice activity detection circuit is configured to assess whether a speech signal is present in the first signal based on the first signal and the second signal.

In Example 5, the subject matter of any one of Examples 2-4 can optionally include that the voice activity detection circuit is configured to assess whether a speech signal is present in the first signal based on an amplitude level difference between the first signal and the second signal.

In Example 6, the subject matter of any one of Examples 2-5 can optionally include that the noise reduction gain determination circuit configured to determine a noise reduction gain based on result of the assessment by the voice activity detection circuit.

In Example 7, the subject matter of any one of Examples 1-6 can optionally include that the noise reduction gain determination circuit comprises a single channel noise estimator configured to estimate the noise in the first signal based on the first signal, wherein the noise reduction gain determination circuit is configured to determine the noise reduction gain based on a noise estimate provided by the single channel noise estimator.

In Example 8, the subject matter of Example 7 can optionally include that the single channel noise estimator is a minimum statistics approach based noise estimator.

In Example 9, the subject matter of any one of Examples 7-8 can optionally include that the single channel noise estimator is a speech presence probability based noise estimator.

In Example 10, the subject matter of any one of Examples 1-9 can optionally include that the noise reduction gain determination circuit comprises two single channel noise estimators, wherein each single channel noise estimator is configured to estimate the noise in the first signal based on the first signal, wherein the noise reduction gain determination circuit is configured to determine the noise reduction gain based on the noise estimates provided by the single channel noise estimators.

In Example 11, the subject matter of Example 10 can optionally include that one of the single channel noise estimators is a minimum statistics approach based noise estimator and the other is a speech presence probability based noise estimator.

In Example 12, the subject matter of any one of Examples 1-11 can optionally include that the audio processing device is a communication device.

In Example 13, the subject matter of any one of Examples 1-12 can optionally include that the audio processing device is a mobile phone.

Example 14, as described with reference to FIG. 2, is a method for reducing noise in an audio signal comprising: receiving a first signal by a first microphone; receiving a second signal by a second microphone; determining a noise reduction gain based on the first signal and the second signal; attenuating the first signal based on the determined noise reduction gain; and outputting the attenuated signal.

In Example 15, the subject matter of Example 14 can optionally include assessing whether a speech signal is present in the first signal.

In Example 16, the subject matter of Example 15 can optionally include assessing whether there is a speech signal corresponding to speech of a user of the audio processing device present in the first signal.

In Example 17, the subject matter of any one of Examples 15-16 can optionally include assessing whether a speech signal is present in the first signal based on the first signal and the second signal.

In Example 18, the subject matter of any one of Examples 15-17 can optionally include assessing whether a speech signal is present in the first signal based on an amplitude level difference between the first signal and the second signal.

In Example 19, the subject matter of any one of Examples 15-18 can optionally include determining a noise reduction gain based on result of the assessment by the voice activity detection circuit.

In Example 20, the subject matter of any one of Examples 14-19 can optionally include estimating the noise in the first signal based on the first signal, and determining the noise reduction gain based on estimating the noise in the first signal.

In Example 21, the subject matter of Examples 20 can optionally include that estimating the noise in the first signal comprises a minimum statistics approach.

In Example 22, the subject matter of any one of Examples 20-21 can optionally include that estimating the noise in the first signal is a speech presence probability based noise estimating.

In Example 23, the subject matter of any one of Examples 14-22 can optionally include that estimating the noise in the first signal comprises using two single channel noise estimators, wherein each single channel noise estimator estimates the noise in the first signal based on the first signal, the method further comprising determining the noise reduction gain based on the noise estimates provided by the single channel noise estimators.

In Example 24, the subject matter of Example 23 can optionally include that one of the single channel noise estimators performs a minimum statistics approach based noise estimation and the other performs a speech presence probability based noise estimation.

In Example 25, the subject matter of any one of Examples 14-24 can optionally include that a communication device performs the method.

In Example 26, the subject matter of any one of Examples 14-25 can optionally include that a mobile phone performs the method.

Example 27 is an audio processing device comprising: a first microphone means for receiving a first signal; a second microphone means for receiving a second signal; a noise reduction gain determination means for determining a noise reduction gain based on the first signal and the second signal; a noise reduction means for attenuating the first signal based on the determined noise reduction gain; and an output means for outputting the attenuated signal.

In Example 28, the subject matter of Example 27 can optionally include a voice activity detection means for assessing whether a speech signal is present in the first signal.

In Example 29, the subject matter of Example 28 can optionally include that the voice activity detection means for assessing whether there is a speech signal corresponding to speech of a user of the audio processing device present in the first signal.

In Example 30, the subject matter of any one of Examples 28-29 can optionally include that the voice activity detection means is for assessing whether a speech signal is present in the first signal based on the first signal and the second signal.

In Example 31, the subject matter of any one of Examples 28-30 can optionally include that the voice activity detection means is for assessing whether a speech signal is present in the first signal based on an amplitude level difference between the first signal and the second signal.

In Example 32, the subject matter of any one of Examples 28-31 can optionally include that the noise reduction gain determination means is for determining a noise reduction gain based on result of the assessment by the voice activity detection circuit.

In Example 33, the subject matter of any one of Examples 27-32 can optionally include that the noise reduction gain determination means comprises a single channel noise estimator means for estimating the noise in the first signal based on the first signal, wherein the noise reduction gain determination means is for determining the noise reduction gain based on a noise estimate provided by the single channel noise estimator.

In Example 34, the subject matter of Example 33 can optionally include that the single channel noise estimator means is a minimum statistics approach based noise estimator means.

In Example 35, the subject matter of any one of Examples 33-34 can optionally include that the single channel noise estimator means is a speech presence probability based noise estimator means.

In Example 36, the subject matter of any one of Examples 27-35 can optionally include that the noise reduction gain determination means comprises two single channel noise estimator means, wherein each single channel noise estimator means is for estimating the noise in the first signal based on the first signal, wherein the noise reduction gain determination means is for determining the noise reduction gain based on the noise estimates provided by the single channel noise estimators means.

In Example 37, the subject matter of Example 36 can optionally include that one of the single channel noise estimator means is a minimum statistics approach based noise estimator means and the other is a speech presence probability based noise estimator means.

In Example 38, the subject matter of any one of Examples 27-37 can optionally include that the audio processing device is a communication device.

In Example 39, the subject matter of any one of Examples 27-38 can optionally include that the audio processing device is a mobile phone.

Example 40 is a computer readable medium having recorded instructions thereon which, when executed by a processor, make the processor perform a method for reducing noise in an audio signal comprising: receiving a first signal by a first microphone; receiving a second signal by a second microphone; determining a noise reduction gain based on the first signal and the second signal; attenuating the first signal based on the determined noise reduction gain; and outputting the attenuated signal.

In Example 41, the subject matter of Example 40 can optionally include recorded instructions thereon which, when executed by a processor, make the processor perform assessing whether a speech signal is present in the first signal.

In Example 42, the subject matter of Example 41 can optionally include recorded instructions thereon which, when executed by a processor, make the processor perform assessing whether there is a speech signal corresponding to speech of a user of the audio processing device present in the first signal.

In Example 43, the subject matter of any one of Examples 41-42 can optionally include recorded instructions thereon which, when executed by a processor, make the processor perform assessing whether a speech signal is present in the first signal based on the first signal and the second signal.

In Example 44, the subject matter of any one of Examples 41-43 can optionally include recorded instructions thereon which, when executed by a processor, make the processor perform assessing whether a speech signal is present in the first signal based on an amplitude level difference between the first signal and the second signal.

In Example 45, the subject matter of any one of Examples 41-44 can optionally include recorded instructions thereon which, when executed by a processor, make the processor perform determining a noise reduction gain based on result of the assessment by the voice activity detection circuit.

In Example 46, the subject matter of any one of Examples 40-45 can optionally include recorded instructions thereon which, when executed by a processor, make the processor perform estimating the noise in the first signal based on the first signal, and determining the noise reduction gain based on estimating the noise in the first signal.

In Example 47, the subject matter of Example 46 can optionally include that estimating the noise in the first signal comprises a minimum statistics approach.

In Example 48, the subject matter of any one of Examples 46-47 can optionally include that estimating the noise in the first signal is a speech presence probability based noise estimating.

In Example 49, the subject matter of any one of Examples 40-48 can optionally include that estimating the noise in the first signal comprises using two single channel noise estimators, wherein each single channel noise estimator estimates the noise in the first signal based on the first signal, the method further comprising determining the noise reduction gain based on the noise estimates provided by the single channel noise estimators.

In Example 50, the subject matter of Example 49 can optionally include that one of the single channel noise estimators performs a minimum statistics approach based noise estimation and the other performs a speech presence probability based noise estimation.

In Example 51, the subject matter of any one of Examples 40-50 can optionally include that a communication device performs the method.

In Example 52, the subject matter of any one of Examples 40-51 can optionally include that a mobile phone performs the method.

It should be noted that one or more of the features of any of the examples above may be combined with any one of the other examples.

In the following, examples are described in more detail.

Figure 3:
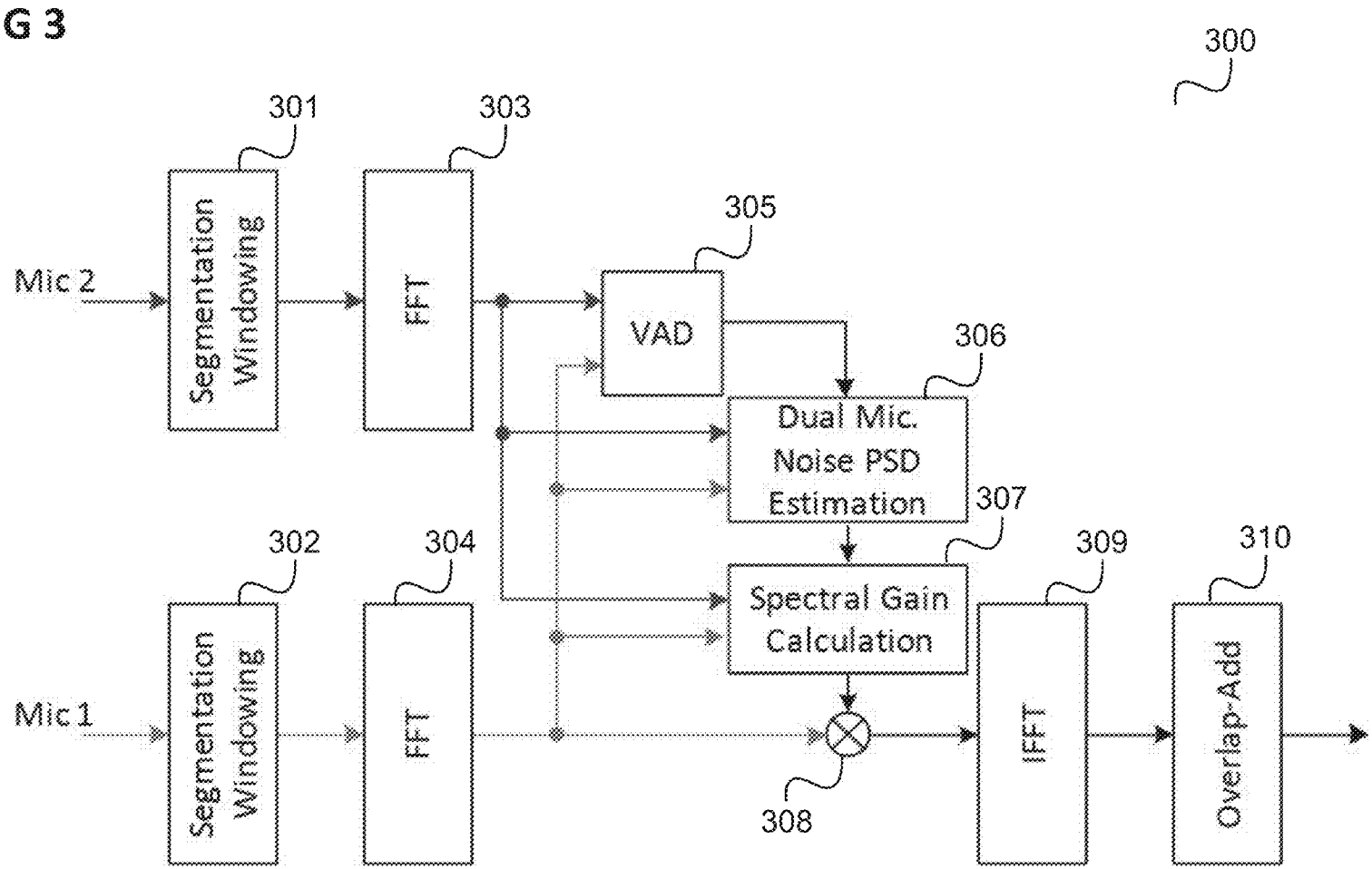
FIG. 3 shows an audio processing device illustrating a dual microphone noise reduction approach.

FIG. 3 shows an audio processing device 300, e.g. implemented by a mobile phone.

The audio processing device 300 includes segmentation windowing units 301 and 302. Segmentation windowing units 301 and 302 segment the input signals xp(k) (from a primary microphone) and xs(k) (from a secondary microphone) into overlapping frames of length M, respectively. Herein, xp(k) and xs(k) may also be referred to as $x_1(k)$ and x2(k). Segmentation windowing units 301 and 302 may for example apply a Hann window or other suitable window. After windowing, respective time frequency analysis units 303 and 304 transform the frames of length M into the short-term spectral domain. The time frequency analysis units 303 and 304 for example use a fast Fourier transform (FFT) but other types of time frequency analysis may also be used. The corresponding output spectra are denoted by Xp(k, m) (for the primary microphone) and Xs(k, m) (for the secondary microphone). Discrete frequency bin and frame index are denoted by m and k, respectively.

The output spectra of both microphones are fed to a VAD (voice activity detection) unit 305, a noise power spectral density (PSD) estimation unit 306 and a spectral gain calculation unit 307.

The VAD unit 305 assesses whether there is speech in the input signals, i.e. whether the user of the audio processing device, e.g. the user of a mobile phone including the audio processing device currently speaks into the primary microphone. The VAD unit 305 supplies the result of the decision to the noise power spectral density (PSD) estimation unit 306.

The noise power spectral density (PSD) estimation unit 306 calculates a noise power spectral density density estimation $\hat{\phi}_{nm}(\lambda, \mu)$ for a frequency domain speech enhancement system. The noise power spectral density estimation is in this example calculated in the frequency domain by $Xp(\lambda, \mu)$ and $Xs(\lambda, \mu)$. The noise power spectral density may also be referred to as the auto-power spectral density.

The spectral gain calculation unit 307 calculates the spectral weighting gains $G(\lambda, \mu)$. The spectral gain calculation unit 307 uses the noise power spectral density estimation and the spectra $Xp(\lambda, \mu)$ and $Xs(\lambda, \mu)$.

A multiplier 308 generates an enhanced spectrum $\overline{S}(\lambda, \mu)$ by the multiplication of the coefficients $Xp(\lambda, \mu)$ with the spectral weighting gains $G(\lambda, \mu)$. An inverse time frequency analysis unit 309 applies an inverse fast Fourier transform to $\hat{S}(\lambda, \mu)$ and then and overlap-add unit 310 applies an overlap-add to produce the enhanced time domain signal $\hat{s}(k)$ Inverse time frequency analysis unit 309 may use an inverse fast Fourier transform or some other type of inverse time frequency analysis (corresponding to the transformation used by the time frequency analysis units 303, 304).

It should be noted that a filtering in the time-domain by means of a filter-bank equalizer or using any kind of analysis or synthesis filter bank is also possible.

Generally, the audio processing device 300 applies a method for reducing noise in a noise reduction system, the method including receiving a first signal at a first microphone; receiving a second signal at a second microphone; identifying a noise estimation in the first signal and the second signal; identifying a transfer function of the noise reduction system using a power spectral density of the first signal and a power spectral density of the second signal and identifying a gain of the noise reduction system using the transfer function.

Implementations of the audio processing circuit 100 such as the ones described below can be seen to be based on this principle. However, examples for the audio processing circuit 100 such as described in the following may be seen to enable integration in a low complexity noise reduction solution by an extension of a single channel noise reduction technique to a dual microphone noise reduction solution. Whereas the audio processing circuit 300 of FIG. 3 can be seen to be natively a dual microphone solution, meaning that noise estimators and the gain rule depends on the signal picked-up by each microphone, this may be seen to not be the case for an implementation of the audio processing circuit 100 such as illustrated in FIG. 4.

Figure 4:
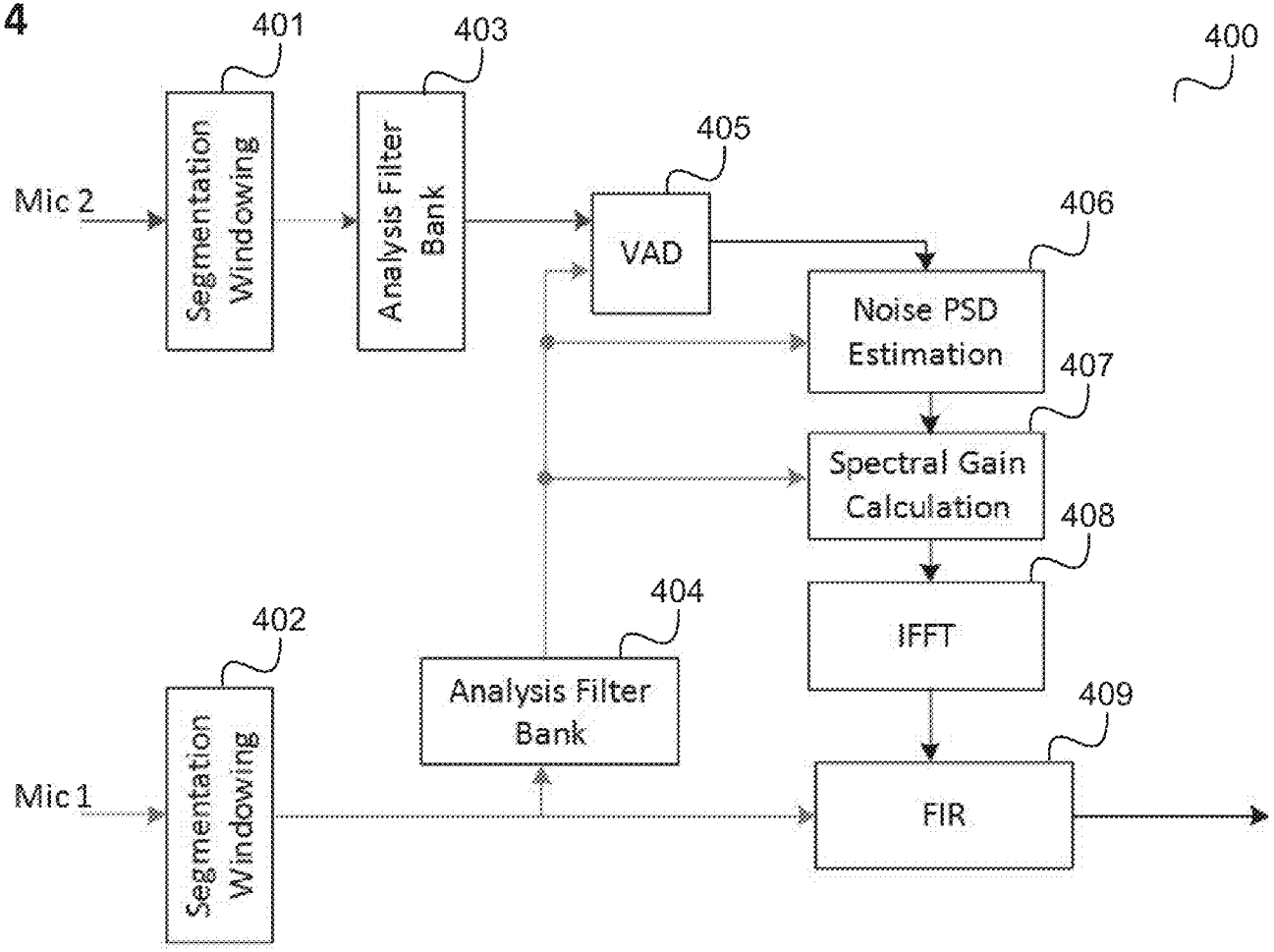
FIG. 4 shows an audio processing device with a different architecture than the audio processing circuit shown in FIG. 3.

FIG. 4 shows an audio processing circuit 400.

Similarly to the audio processing circuit 300, the audio processing circuit 400 includes segmentation window units 401, 402, a VAD unit 405, a noise power spectral density (PSD) estimation unit 406 and a spectral gain calculation unit 407. In place of the time frequency analysis units 303, 304 the audio processing circuit 400 in this example includes analysis filter banks 403, 404.

In contrast to the audio processing circuit 300, only the output of the analysis filter bank 404 processing the input signal of the primary microphone is input to the noise power spectral density (PSD) estimation unit 406 and the spectral gain calculation unit 407. The output of the spectral gain calculation unit 407 is processed by an inverse time frequency analysis unit 408 similar to the inverse time frequency analysis unit 309 and the segmented input signal of the primary microphone is filtered by a FIR filter unit 409 based on the output of the inverse time frequency analysis unit 408.

In that sense, the gain rule and noise estimation procedures used by the audio processing unit 400 are different from the ones used by the audio processing unit 300. The following four aspects with regard to mobile terminals are for example addressed:

1. Complexity in terms of MIPS (million instructions per second)/MCPS(million cycles per second), memory and delay. Modern mobile terminals typically include several kinds of speech and audio processing algorithms in order to meet users' expectations. These audio features are demanding in terms of computational power and memory and thus it is usually crucial to limit the complexity of each solution/feature in order to enable their integration within a mobile terminal. Furthermore to provide natural sounding conversation it is typically important to keep the end to end delay low.
2. Robustness regarding the echo signal coming from the existing coupling between the loudspeaker and the microphones. Noise reduction modules in mobile phones typically have to co-exist with echo reduction modules and it is usually critical to avoid any bad interactions that could lead to a loss in overall performance.
3. Scalability in terms of frequency resolution. To take into account the complexity/delay mentioned in the 1, the audio processing circuits 100, 400 may be designed to work with a limited frequency resolution, typically 8 or 16 bands in narrow band call (8 kHz sampling rate). At this resolution the discrimination between speech, noise and echo signals is typically much more challenging than in high resolution (e.g. 128 to 256 bands). It may also be ensured that it performs equally well in higher resolution. A basic idea can be seen in that it is algorithmically easier to maintain quality by increasing frequency resolution compared to decreasing resolution, as at frequency resolutions the speech, noise and echo components typically do not have a significant overlap.

The audio processing circuit 100 may include the following components (e.g. as part of a Dual Microphone Noise Reduction (DNR) module):

Power level estimation (PLE) based voice activity detection (VAD). This block occurs before the noise estimation and the noise reduction (NR) gain calculation blocks. Compared to an audio processing circuit such as the audio processing circuit 300, two adaptations may be done for integration in a low-complexity noise reduction implementation. The PLE block monitors the amplitude level of the signals on each microphone in order to build a VAD that is used to drive the noise estimation. To ensure robustness to variations of phone position, a smoothing is introduced. This is the first adaptation. The second adaptation is that the initial three states logic is simplified as compared to what is described with reference to FIG. 3 due to the frequency resolution, DNR noise estimator driven by the VAD including two single channel noise estimators. The VAD comes from the PLE block. Regarding the two single channel noise estimators, one comes from a single channel noise reduction (NR) approach based on minimum statistics approach. The second one is based on speech presence probability estimation. Those two estimators are updated for every new frame and are used to limit the maximum variations of the DNR noise estimation in order to control the amount of noise reduction with respect to the speech quality, Logic to ensure robustness of DNR algorithm. Safety nets are put in place to avoid false detections in the speech presence probability evaluation procedure. For example, as the frequency resolution is limited, there is an overlap between the components of the useful speech and the components of the echo signal leading to a wrong signal classification. This logic avoids strong distortions on the useful speech in the case mentioned above, Gain rule obtained with the information extracted from the two microphones based on a modification of single channel noise reduction gain rule.

Figure 5:
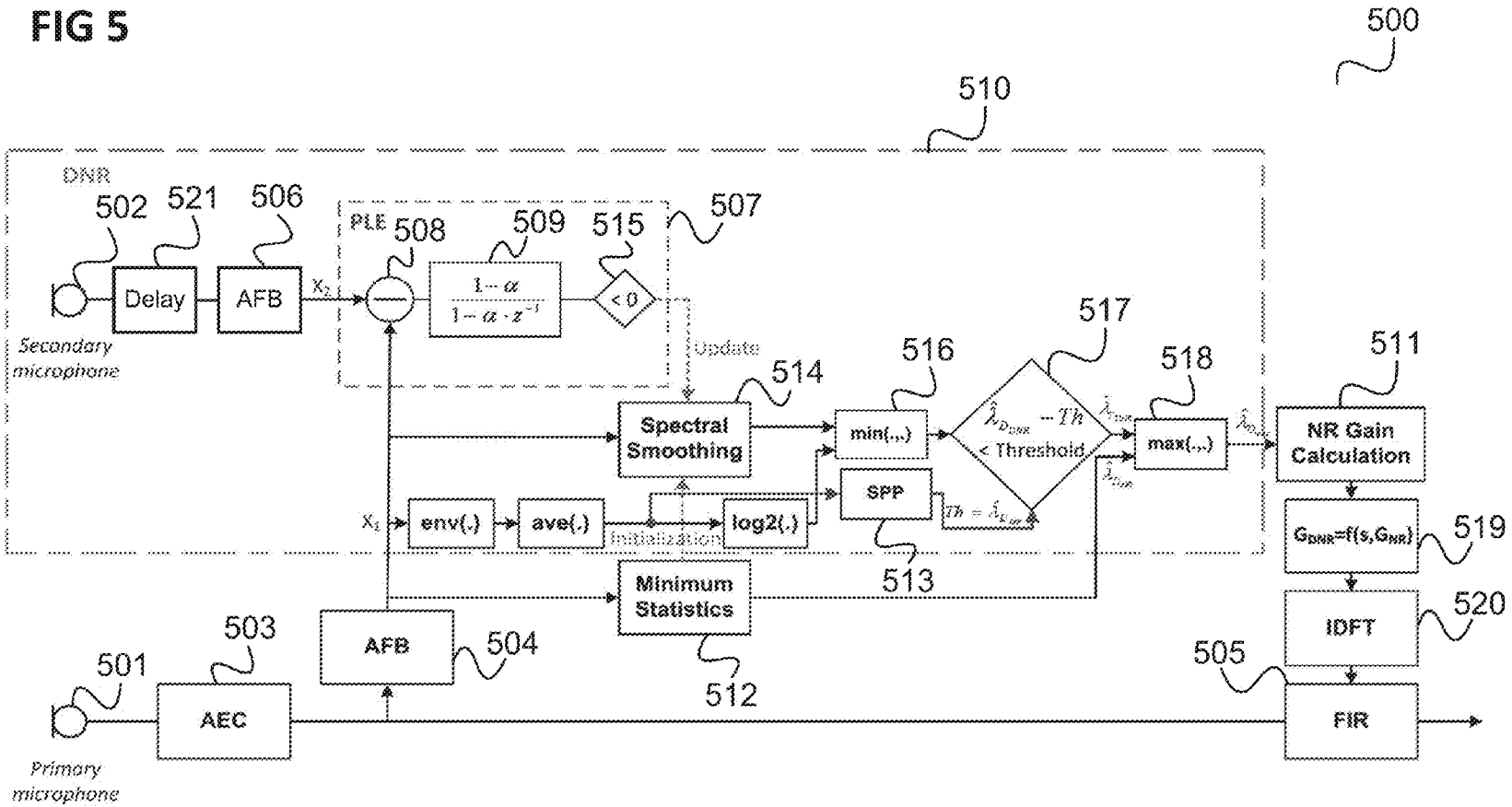
FIG. 5 shows an audio processing circuit in more detail.

FIG. 5 shows an audio processing circuit 500 giving examples for these components.

The audio processing circuit 500 includes a primary microphone 501 and a secondary microphone 502 which each provide an audio input signal. The input signal of the primary microphone 501 is processed by a pre-processor, for example an acoustic echo canceller 503. The output of the acoustic echo canceller 503 is supplied to a first analysis filter bank 504 (e.g. performing a discrete Fourier transformation) and to a FIR filter 505.

The input signal of the secondary microphone 502 is supplied to delay block 521, which may delay the signal to compensate for the delay introduced by the pre-processor (for example AEC 503 (acoustic error canceling, like will be described in more detail below)). The output of the delay block 521 is supplied to a second analysis filter bank 506 (e.g. performing a discrete Fourier transformation).

The analysis filter banks 504, 506 for example decompose the microphone input signals in the frequency domain into sub-bands to give $X_i(k, m)$ for frequency bin k and time frame m wherein i=1 for the primary microphone 501 and i=2 for the secondary microphone 502.

In the following, it is assumed that speech and noise signals (included in the input signals) are additive in the short time Fourier domain. The complex spectral noisy observation on the primary microphone is thus given by $$X_1(k,m)=S_1(k,m)+D_1(k,m)$$

where $S_1(k,m)$ are the complex spectral speech coefficients and $D_1(k,m)$ are the complex spectral noise coefficients for frequency bin k and time frame m. For each k, the spectral speech and noise power are defined as:

$$\lambda_{S_1}{}^2(k,m)=E[|S_1(k,m)|^2]$$

$$\lambda_{D_1}{}^2(k,m)=E[|D_1(k,m)|^2]$$

The goal can be seen to get an accurate estimate of the noise power spectral density $\lambda_{D_1}$ in order to compute the DNR gain that is on the noisy observation (i.e. input signal). To do so, three noise estimators are used.

In order to control the noise estimator used in the DNR algorithm and based on spectral smoothing of the pseudo-magnitude of the signal picked-up by the primary microphone, a VAD is provided by a PLE block 507. The PLE block 507 measures the amplitude level difference between the microphone signals by means of a subtracting unit 508 based on the output of the first analysis filter bank 504 and the output of the second analysis filter bank 506. This difference is of interest, especially when the microphones are placed in a bottom-top configuration, as illustrated in FIG. 6.

Figure 6:
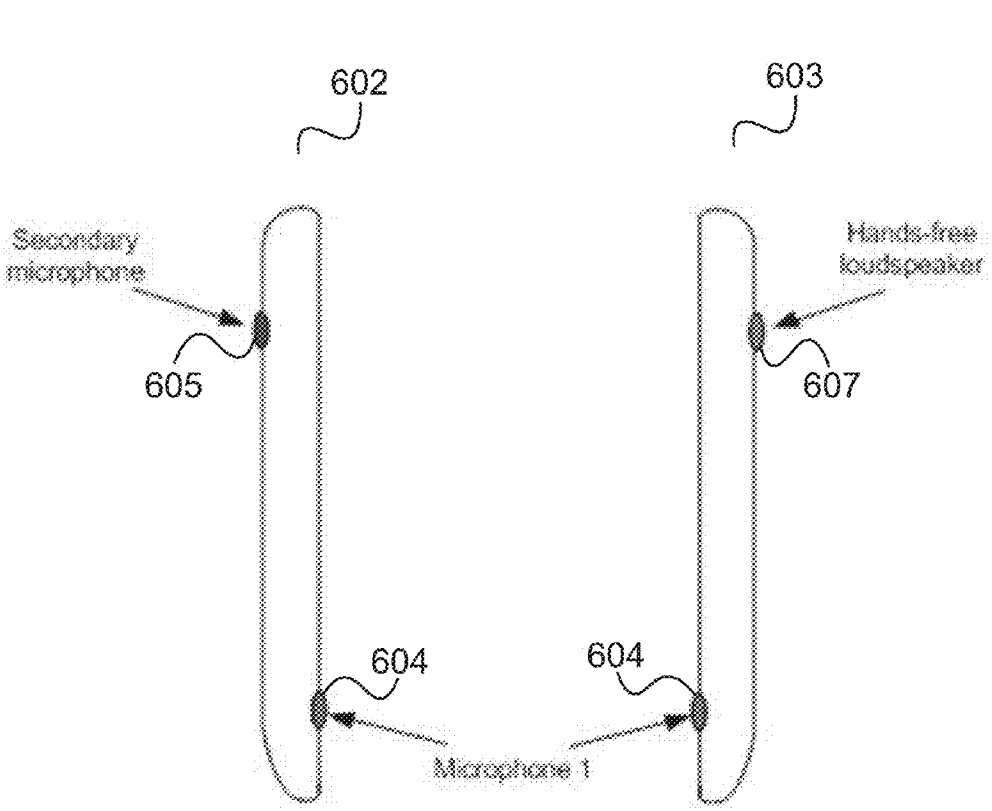
FIG. 6 shows a front view and side views of a mobile phone illustrating microphone positioning.
Figure 6:
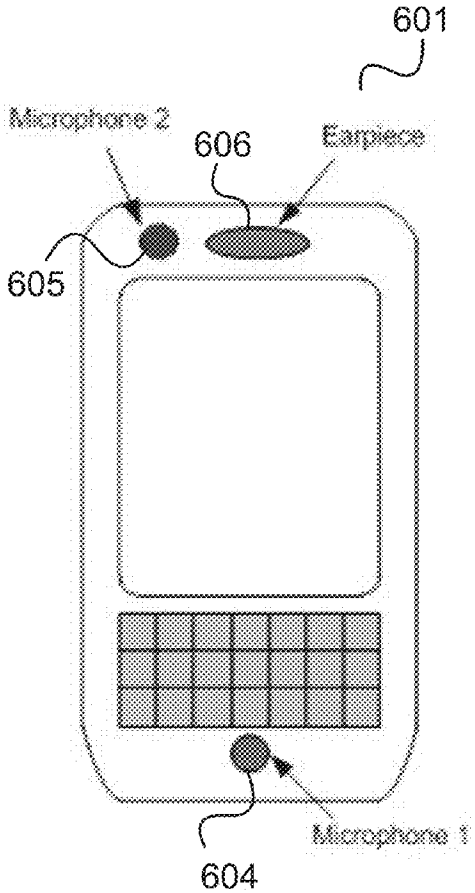

FIG. 6 shows a front view 601 and side views 602, 603 of a mobile phone.

In this example, in a bottom-top configuration, a primary microphone 604 is placed at the front side at the bottom of the mobile phone and a secondary microphone 605 is placed at the top side of the mobile phone, either on the front side next to an earpiece 606 (as shown in front view 601) or at the back side of the mobile phone, e.g. next to a hands-free loudspeaker 607 (as shown in side views 602, 603).

For such a configuration and in handset (i.e. not hands-free) mode, the amplitude level difference is typically close to zero when the microphone signals have the same amplitude. This case corresponds to a pure noise only period for a diffuse noise type. On the contrary, as soon as the user is speaking, the amplitude level will be higher on the primary microphone and then the amplitude level difference is positive. Also for a hands-free mode, the amplitude level difference may be close to zero when the microphone signals have the same amplitude.

The amplitude level difference is for example given by $$\Delta\Phi(k,m)=|X_1(k,m)|-\text{CrossComp}\times|X_2(k,m)|$$

wherein the parameter CrossComp allows compensating for any bias or mismatch which may exist between the gains of the microphones 501, 502.

The audio processing circuit 500 includes a smoothing block 509 which smoothes the amplitude level difference calculated by the subtracting unit in order to avoid near-end speech attenuation during single talk (ST) period. In that sense, the DNR is more robust to any delay mismatch between the microphone signals and that could come up due to a change in the phone positions or an inaccurate compensation of the processing delay of the AEC (acoustic error canceling). It should be noted that the AEC is only performed on the primary microphone input signal and its processing delay may be compensated so that it does not disturb the VAD. To compensate any mismatch in the microphones gains, a scaling value may be used to multiply the secondary microphone signal so that it is possible to avoid any bias coming from the microphones characteristics. In other words, robustness to hardware variations may be ensured.

The PLE block 507 is part of a DNR block 510. The output of the DNR block 508 is a DNR noise estimate $\hat{\lambda}_{D_{max}}$ that is fed to a NR gain computation block 511. The DNR block 508 includes two different kinds of noise estimators: A slow time-varying one and a fast tracking one. For example, the two following noise estimates are used:

a. $\hat{\lambda}_{D_{NR}}$ which tracks the minimum of the noisy speech power and is provided by a minimum statistics block 512 based on a minimum statistics approach calculated from the output of the first analysis filter bank. The minimum statistics block 512 is for example a noise estimator coming from a single microphone noise reduction module. This noise estimate has the advantage of preserving the useful speech signal. However, it is conservative and it has a long convergence time.

b. $\hat{\lambda}_{D_{SPP}}$ generated by an SPP block 513 (based on an averaged envelope of the output of the output of the first analysis filter bank) and driven by speech presence probability. It is also a single channel noise estimate but is able to follow highly non-stationary noise sources without convergence time.

The DNR noise estimator combines and exploits these noise estimates in order to obtain an accurate and robust noise estimation. A spectral smoothing block 514 may compute a DNR noise estimate based on the output of the first analysis filter bank and the result of the VAD provided by a decider 515 based on the output of the smoothing block 509. First, to avoid that the DNR noise estimate computed in the spectral smoothing block 514 may freeze to an unexpected value after a transition period, speech plus noise to noise only, the estimate by the spectral smoothing block 514 is compared by a first comparator 516 with the magnitude of the primary microphone signal with minimum rule to provide $\hat{\lambda}_{D_{DNR}}$.

Secondly, the standard deviation of $\hat{\lambda}_{D_{max}}$ is limited through a threshold (referred to as Threshold in FIG. 5). This is to ensure no attenuation of the useful speech signal during periods when both near-end user and far-end user are speaking together (i.e. double talk (DT) periods). To do so, $\hat{\lambda}_{D_{SPP}}$ is used as threshold signal Th by a second comparator 517. To improve even more the robustness of $\hat{\lambda}_{D_{SPP}}$, the update of $\hat{\lambda}_{D_{SPP}}$ may also be driven by the DNR VAD result, meaning that Th=$\hat{\lambda}_{D_{SPP}}$ is driven by a software VAD using speech presence probability and a hardware VAD exploiting power level difference. Then, by comparing the difference of $\hat{\lambda}_{D_{DNR}}$ with Th and only outputting the noise estimate $\hat{\lambda}_{D_{DNR}}$ if $\hat{\lambda}_{D_{DNR}}$−Th<Threshold, the aggressiveness and the speech quality after the DNR processing can be controlled, especially during double talk period by setting accordingly the value of Threshold. For example, if $\hat{\lambda}_{D_{DNR}}$−Th<Threshold is not fulfilled, an earlier value of $\hat{\lambda}_{D_{DNR}}$(e.g. of the preceding frame) is used. In other words, no update is performed in this case for the current frame.

A third comparator 518 compares and $\hat{\lambda}_{D_{DNR}}$ and $\hat{\lambda}_{D_{NR}}$ outputs the maximum of these two estimates as a DNR noise estimate $\hat{\lambda}_{D_{max}}$.

The usage of the maximum rule can be seen to be motivated by the need in practice to overestimate the noise, especially to control the musical noise, before feeding the DNR gain rule with $\hat{\lambda}_{D_{max}}$. In addition, two scaling variables may be used within the maximum function of the third comparator 518 to weight the contribution of each noise power spectral density estimators, $\hat{\lambda}_{D_{DNR}}$ and $\hat{\lambda}_{D_{NR}}$, in order to meet the tradeoff between speech quality and amount of noise reduction.

To derive the DNR gain rule and improve the noise reduction compared to a single channel approach, information of speech presence probability extracted from the SPP block 513 is reused. The SPP information $\overline{P}$ is used as input parameter of a sigmoid function, s($\overline{P}$,a,b), that can be tuned through two additional parameters a and b. Those two parameters permit to modify the shape of the sigmoid function and thus to control the aggressiveness of the gain applied on the noisy signal. Other alternative functions can be used.

For example, one of the following gain rules is used:

(a) Gain rule #1:

$$G_{DNR}=0.8\times G_{DNR}+0.2\times G_{NR}\times NG\text{factor}^{(1-s(\overline{P},a,b))}$$

(b) Gain rule #2:

$$G_{DNR}=s(\overline{P},a,b)\times G_{NR}$$

Both gain rules are based on the gain determined by the NR gain computation block 511. The NR gain $G_{NR}$ is based on a perceptual gain function which is illustrated in FIG. 7.

Figure 7:
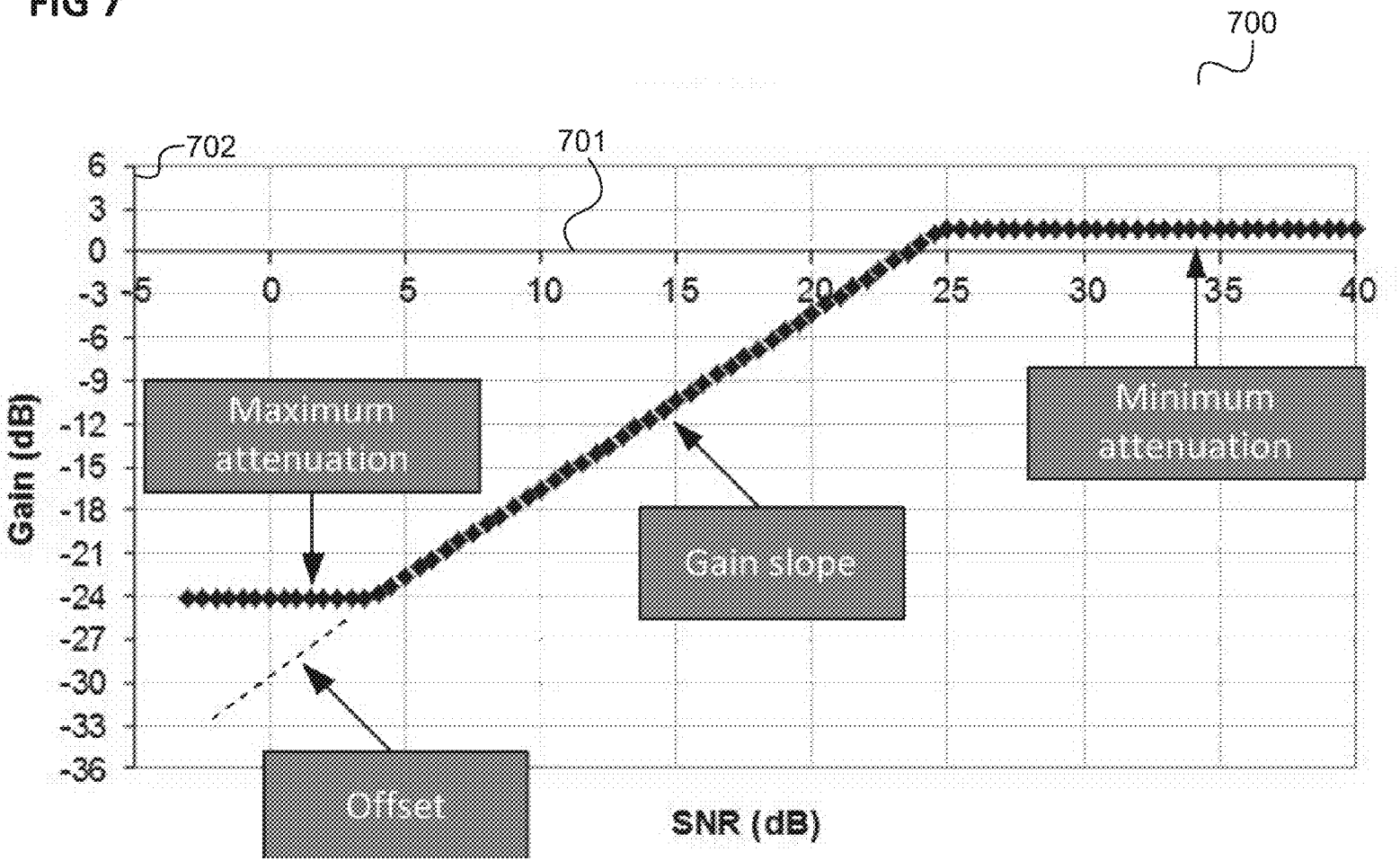
FIG. 7 shows a diagram illustrating a gain rule.

FIG. 7 shows a diagram 700 illustrating a gain rule.

The SNR (signal to noise ratio) is given in dB along an x-axis 701. The gain is given in dB along an y-axis 702.

$G_{NR}$ is a function of the a posteriori SNR and for each sub-band component, it is calculated according to $$G_{NR}=\gamma(k,m)\times\beta(k)+\text{goffset}(k)$$

where β(k) corresponds to the gain slope, γ(k,m) is the a posteriori SNR and goffset(k) is the gain offset in dB.

The a posteriori SNR is defined by $\gamma(k,m)=|X_1(k,m)|^2/\lambda_{D_1}{}^2(k,m)$ The first gain rule according to (a) can be set to be aggressive through the constant NGfactor. This parameter overcomes the maximum attenuation computed by the noise reduction gain in case of single channel noise reduction. Indeed, as a more reliable noise estimate is received, the amount of noise reduction can be increased. This NGfactor is for example in the range [0.1 1]. NGfactor=$^1$ means that the noise reduction gain is smoothed.

The second gain rule according to (b) modifies the shape of the noise reduction gain differently and can also be set to be aggressive by modifying the shape of the sigmoid function by modifying the parameters a and b. Basically, the center and the width of the sigmoid can be modified to 'shift' a Wiener gain in function of the speech presence probability value, leading to a more or less aggressive noise reduction.

The gain is determined by a gain calculation block 519, processed by an inverse discrete Fourier transformation 520 and supplied to the FIR filter 505 which filters the primary microphone input signal (processed by echo cancellation) accordingly.

Examples of the audio processing circuit 100 such as described above allow discriminating speech, echo and noise to achieve higher noise reduction with a low complexity and low delay method that is desired for mobile devices implementation.

By taking benefit of the propagation laws of any acoustic waves, a basic detector able to classify speech time frames from echo and noise only time frames may be provided.

Further, the audio processing circuit 100 can be implemented with low processing delay. This enables building mobile devices that meet standards requirements (3 GPP specifications & HD Voice certification).

Additionally, examples of the audio processing circuit 100 such as described above allow scalability. As they are independent of the frequency resolution, they can be used for low and high frequency noise reduction solutions. This is interesting from a platform point of view, as it enables a deployment over different products (e.g. mobile phones, tablets, laptops . . . ) according to their computational power.

Further, robustness towards echo signal and device position can be achieved. The safety nets combined with the VAD render the noise estimation procedure accurate. This accuracy is obtained after a two-step procedure that controls the noise estimation and reduces false detections.

The results show that a good performance can be achieved for both stationary and non-stationary background noises. The performance above has been achieved with a complexity of 5 MCPS, and 1.2 ms delay (narrowband mode).

While specific aspects have been described, it should be understood by those skilled in the art that various changes in form and detail may be made therein without departing from the spirit and scope of the aspects of this disclosure as defined by the appended claims. The scope is thus indicated by the appended claims and all changes which come within the meaning and range of equivalency of the claims are therefore intended to be embraced.

The invention claimed is:

1. An audio processing device comprising:

a first microphone configured to receive a first signal;

a second microphone configured to receive a second signal;

a noise reduction gain determination circuit comprising a noise power density estimator configured to determine a noise power density estimate based on the first signal and the second signal, and a gain calculator configured to receive as inputs a signal from the first microphone and the noise power density estimate in order to determine a noise reduction gain, wherein the noise reduction gain is determined using the signal from the first microphone and the noise power density as the only inputs;

a noise reduction circuit configured to attenuate the first signal based on the determined noise reduction gain; and an output circuit configured to output the attenuated signal.

2. The audio processing device of claim 1, further comprising a voice activity detection circuit configured to assess whether a speech signal is present in the first signal.

3. The audio processing device of claim 2, wherein the voice activity detection circuit is configured to assess whether a speech signal is present in the first signal based on the first signal and the second signal.

4. The audio processing device of claim 2, wherein the voice activity detection circuit is configured to assess whether a speech signal is present in the first signal based on an amplitude level difference between the first signal and the second signal.

5. The audio processing device of claim 2, wherein the noise reduction gain determination circuit is configured to determine the noise reduction gain based on the assessment by the voice activity detection circuit.

6. The audio processing device of claim 2, wherein the noise reduction gain determination circuit comprises a single channel noise estimator configured to estimate the noise in the first signal based on the first signal, wherein the noise reduction gain determination circuit is configured to determine the noise reduction gain based on a noise estimate provided by the single channel noise estimator.

7. The audio processing device of claim 6, wherein the single channel noise estimator is a minimum statistics approach based noise estimator.

8. The audio processing device of claim 6, wherein the single channel noise estimator is a speech presence probability based noise estimator.

9. The audio processing device of claim 2, wherein the noise reduction gain determination circuit comprises two single channel noise estimators, wherein each single channel noise estimator is configured to estimate the noise in the first signal based on the first signal, wherein the noise reduction gain determination circuit is configured to determine the noise reduction gain based on the noise estimates provided by the single channel noise estimators.

10. The audio processing device of claim 9, wherein one of the single channel noise estimators is a minimum statistics approach based noise estimator and the other is a speech presence probability based noise estimator.

11. The audio processing device of claim 1, wherein the audio processing device is a communication device.

12. The audio processing device of claim 1, wherein the audio processing device is a mobile phone.

13. A method for reducing noise in an audio signal comprising receiving a first signal by a first microphone;

receiving a second signal by a second microphone;

determining a noise power density estimate based on the first signal and the second signal;

determining a noise reduction gain using a signal from the first microphone and the noise power density estimate as inputs, wherein the noise reduction gain is determined using the signal from the first microphone and the noise power density as the only inputs;

attenuating the first signal based on the determined noise reduction gain; and outputting the attenuated signal.

14. The method of claim 13, further comprising assessing whether a speech signal is present in the first signal.

15. The method of claim 14, further comprising assessing whether a speech signal is present in the first signal based on the first signal and the second signal.

16. The method of claim 14, further comprising assessing whether a speech signal is present in the first signal based on an amplitude level difference between the first signal and the second signal.

17. The method of claim 14, further comprising determining the noise reduction gain based on result of the assessment by the voice activity detection circuit.

18. The method of claim 13, further comprising estimating the noise in the first signal based on the first signal, and determining the noise reduction gain based on estimating the noise in the first signal.

19. The method of claim 18, wherein estimating the noise in the first signal comprises a minimum statistics approach.

20. The method of claim 18, wherein estimating the noise in the first signal is a speech presence probability based noise estimating.

21. The method of claim 13, wherein estimating the noise in the first signal comprises using two single channel noise estimators, wherein each single channel noise estimator estimates the noise in the first signal based on the first signal, the method further comprising determining the noise reduction gain based on the noise estimates provided by the single channel noise estimators.

22. A non-transitory computer readable medium having recorded instructions thereon which, when executed by a processor, make the processor perform a method for reducing noise in an audio signal comprising:

receiving a first signal by a first microphone;

receiving a second signal by a second microphone;

determining a noise power density estimate based on the first signal and the second signal;

determining a noise reduction gain using a signal from the first microphone and the noise power density estimate as inputs, wherein the noise reduction gain is determined using the signal from the first microphone and the noise power density as the only inputs;

attenuating the first signal based on the determined noise reduction gain; and outputting the attenuated signal.

23. The non-transitory computer readable medium of claim 22, further having recorded instructions thereon which, when executed by a processor, make the processor perform assessing whether a speech signal is present in the first signal.

* * * * *